US009005056B2

(12) United States Patent
Pegnatori

(10) Patent No.: US 9,005,056 B2
(45) Date of Patent: Apr. 14, 2015

(54) BASEBALL BAT

(71) Applicant: Carl Pegnatori, Yucaipa, CA (US)

(72) Inventor: Carl Pegnatori, Yucaipa, CA (US)

( * ) Notice: Subject to any disclaimer, the term of this patent is extended or adjusted under 35 U.S.C. 154(b) by 0 days.

(21) Appl. No.: 13/954,901

(22) Filed: Jul. 30, 2013

(65) Prior Publication Data

US 2014/0135154 A1 May 15, 2014

Related U.S. Application Data

(60) Provisional application No. 61/677,076, filed on Jul. 30, 2012.

(51) Int. Cl.
*A63B 59/00* (2006.01)
*A63B 59/06* (2006.01)

(52) U.S. Cl.
CPC ..... *A63B 59/0092* (2013.01); *A63B 59/06* (2013.01); *A63B 59/0096* (2013.01); *A63B 59/0033* (2013.01); *A63B 2209/00* (2013.01)

(58) Field of Classification Search
CPC ..... A63B 59/06; A63B 59/0096
USPC ..... 473/564, 565, 566, 567, 568, 519, 520
See application file for complete search history.

(56) References Cited

U.S. PATENT DOCUMENTS

| | | | | |
|---|---|---|---|---|
| 5,415,398 | A | 5/1995 | Eggiman | |
| 5,511,777 | A * | 4/1996 | McNeely | 473/520 |
| 6,425,836 | B1 | 7/2002 | Misono et al. | |
| 7,014,580 | B2 * | 3/2006 | Forsythe et al. | 473/566 |
| 8,007,381 | B2 * | 8/2011 | Watari et al. | 473/566 |
| 8,100,787 | B2 | 1/2012 | Smith | |
| 8,298,102 | B2 * | 10/2012 | Chauvin et al. | 473/566 |
| 8,602,924 | B2 * | 12/2013 | Shindome et al. | 473/566 |
| 2011/0105255 | A1 | 5/2011 | Watari et al. | |

* cited by examiner

*Primary Examiner* — Melba Bumgarner
*Assistant Examiner* — Laura L Davison
(74) *Attorney, Agent, or Firm* — Kenneth Avila

(57) ABSTRACT

A hollow non-wood baseball or softball bat wherein the impact portion of the bat contains an inner barrel that is positioned by means of a (i) foam insert, (ii) tube extending from the bat's knob, or (iii) line attached to the bat's knob and end cap and extending throughout the bat such that the inner barrel does not come into contact with the inside wall of the bat when the bat is at rest yet when swung the inner barrel is allowed to move so as to amplify the rebound effect given to the ball upon impact with the bat.

2 Claims, 8 Drawing Sheets

BASEBALL BAT

CROSS-REFERENCE TO RELATED APPLICATIONS

This application claims the benefit of U.S. Provisional Application No. 61/677,076, filed Jul. 30, 2012, which is incorporated herein by reference in its entirety.

In addition this application references the following US patents:

U.S. Pat. No. 5,415,398 filed June 1994 by Eggiman.

U.S. Pat. No. 5,511,777 filed February 1994 by McNeely.

U.S. Pat. No. 6,425,836 filed December 1999 by Misono et al.

U.S. Pat. No. 8,100,787 filed January 2010 by Smith.

BACKGROUND OF THE INVENTION

1. Field of the Invention

The present invention is generally related to the field of baseball and softball and more specifically to a baseball or softball bat.

2. Description of the Related Art

High performance baseball and softball bats, hereinafter referred to simply as "baseball bats" or "bats", are primarily made from aluminum alloys, composite materials, or some combination thereof. These bats are tubular (hollow inside) so as to optimize their weight and they consist of three sections: a relatively narrow handle portion for gripping, a relatively wider distal portion for hitting, and a tapered mid-section connecting the handle and hitting portions. Original aluminum bats were fabricated as a single piece in that they solely consisted of a frame with nothing occupying the space within the frame. It was found that these bats outperformed traditional wooden bats because of a "rebound" effect present in aluminum/composite bats. As the ball impacted the bat, the bat wall would absorb the energy from the impact by elastically deforming the wall at the point of impact. As the ball began to leave the bat the energy absorbed by the elastic deformation would be released by the wall returning to its original structure, in effect giving the ball an extra "push", thus the rebound effect. Another name given to this effect is the "trampoline" effect. Manufacturers of bats found that by making the wall thinner the rebound effect would be magnified. However thinner walls also decreased the life of the bat as the wall would fatigue and no longer return to its original position; leaving dents or dings on the bat. As a result manufacturers begin to look at ways of utilizing the cavity within the hitting portion of the bat to increase the rebound effect and reduce fatigue.

A number of designs were introduced to take advantage of the space available in the cavity of the bat's hitting portion with the goal of strengthening the hitting portion while maintaining or improving the rebound effect. Some designs would decrease the width of the cavity so as to add an outer tubular sleeve while other designs would add tubular inserts within the cavity of the bat's hitting portion. These designs became to be known as multi-walled bats. Still other designs added composites to the outer wall or disks within the cavity to strengthen the wall while maintaining its flexing properties. These designs continued to be known as single wall bats. As this disclosure is for a bat with a novel method of utilizing a tubular insert this discussion will focus on multiwall bat disclosures.

Multiwall bat designs may be broken down into two groups. The first group have walls that are distinct from each other yet each wall directly and continuously adjoins adjacent walls. Although the walls may flex independently from each other the fact that they adjoin one another only allows for minor improvements to the rebound effect. The second group have walls where a gap(s) between the walls have been purposefully incorporated. The gap(s) allow for greater independent flexing of the walls with a corresponding greater improvement of the rebound effect so that the rebound effect may increase more linearly.

Examples of bats with multiple walls that directly abuts one another include U.S. Pat. No. 5,303,917 to Uke and U.S. Pat. No. 6,440,017 to Anderson which both discloses a bat with a sleeve over the outside of the hitting portion that directly and continuously adjoins the frame of the bat's hitting portion. Examples of bats with internal walls, referred to as inserts, includes U.S. Pat. No. 5,364,095 to Easton which discloses an internal insert bonded to the inside of the external metal tube and running the full length of the hitting portion of the bat and U.S. Pat. No. 6,425,836 to Misono et al. which discloses an internal insert with a weak boundary layer so as to encourage some amount of independent flexing. The advantage of these designs is simplicity in manufacturing. Since the walls directly and continuously adjoin each other they are less likely to separate. However this simplicity comes at a cost to performance as less energy is absorbed from the ball's impact with the bat resulting in a less than desired rebound effect.

Examples of bats with multiple walls that incorporate some sort of gap between the walls include U.S. Pat. No. 5,414,398 to Eggiman which discloses a bat with a tubular insert that is placed within the bat's hitting portion. The outside diameter of the insert is smaller than the inside diameter of the bat's outer shell so that there exists an annular gap between the two. The outside shell and tubular insert are therefore able to flex independently and, by so doing, together act as a leaf spring, resulting in greater bat performance. To prevent the insert from moving about within the frame it is secured by friction fit or fasteners. Another example is U.S. Pat. No. 6,612,945, also to Anderson, that contains a spiral inspired textured insert that makes contact with the bat's frame at each apex of the spiral. While the two walls are not as independent as the Eggiman patent they do act with greater independence than walls that directly and continuously adjoin one another. The spiral inspired textured insert is seated against a buttress at one end of the hitting portion and secured by the bat's end cap at the opposite end of the hitting portion. A final example is U.S. Pat. No. 8,007,381 to Watari et al. which discloses a bat with sleeve that fits over the outside of the hitting portion with an inside diameter larger than the outside diameter of the bat's frame such that a gap exists between the two. The sleeve is secured to the bat's frame by both structural elements and adhesives at both ends of the sleeve. The walls in multiwall bats that contain gaps between the walls are able to absorb more energy from an impact with a ball as they are able to flex with greater independence from each other. The increase in flexing in turn improve the bat's rebound effect and performance.

However all of the designs presented here are, in essence, single wall designs as the separate walls are securely connected or make contact, either continuously or at two or more points, with each other. As a result energy absorbed by the bat is transmitted to each wall at multiple points, not just the point of impact. Additionally the walls, since they are connected to each other, freely allow energy absorbed as vibrations to travel along the full length of the bat's frame and every structural element attached to the bat's frame.

On impact with a ball a bat absorbs energy by two means; flexing and vibrating. Energy that flexes the wall leads to improved rebound effect. In the multiwall designs presented here the walls will flex at each point they are in contact with each other. Using the Eggiman patent as an example the inner wall will flex at the two points where it is secured to the outer wall and where the ball impacts with the outer wall. Although most of the energy that flexes the inner wall will be at the point of impact some flexing energy will "bleed away" at the other two points where the inner wall is secured to the outer wall and correspondingly reduce the amount of flexing at the point of impact. When a ball impacts a bat the bat will vibrate. Although the bat will always vibrate the amount of vibrations may sometimes be felt by the batter and can lead to the batter experiencing a "stinging" sensation in their hands. Energy absorbed as vibrations adversely affects the rebound effect in two ways. First it can be easily seen that vibration energy directly subtracts from flexing energy in that the more energy absorbed by vibration the less energy is available to be absorbed for flexing. Vibrations also adversely impact the rebound effect by actively working against the wall flexing. Vibrations are an oscillatory effect creating an equal amount of movement away from a resting point. As the wall is flexed energy will have to be expended to overcome the vibrations resulting in a reduction of the energy used to flex the wall and therefore a less than optimal rebound effect.

The prior art designs presented herein provide for a less than optimal rebound effect by means of the multiple points of contact between the walls and the multiple points of contact allow vibrations to spread throughout the bat.

BRIEF SUMMARY OF THE INVENTION

Therefore, in view of the foregoing, it is an object of the present invention to provide a bat that incorporates walls that are not secured with each other so that each wall may fully flex independently of any adjacent wall to enhance the rebound effect and damping vibrations. It is another object of the present invention to provide a multiwall design that may be easily manufactured.

To meet the first object the bat of the present invention will comprise of a tubular bat frame with a narrow handle portion at one end, a larger hitting portion opposite to the handle portion, and a tapered portion between the two. The narrow handle portion is capped by what is called a knob, a wider piece that keeps the bat from sliding out of a batter's hands. The larger hitting portion is capped by what is called the end cap, a plastic or metal cap to cover the cavity of the tubular bat and prevent deformation of the end of the hitting portion of the bat if it is struck by the ball. An insert of a smaller outside diameter than the inside diameter of the hitting portion of the bat frame is positioned within the hitting portion of the bat frame. When the bat is at rest the insert does not make any contact with the bat frame. When the bat is swung the insert is deterred or prevented from moving axially within the hitting portion by any one of the embodiments to be described hereafter. Since the insert is not fastened or attached to the bat frame in any manner, when the ball makes contact with the bat, the insert is able to absorb a greater amount of the energy than inserts of prior art bats that are physically attached to the bat frame. The greater energy absorbed in turn causes a larger rebound effect. The sum total of the rebound effect of the wall of the hitting portion of the bat and the insert is greater than prior art bats resulting in a higher performance bat. The insert will also dampen vibrations by not being connected to the frame of the bat and by compressing against the wall on the side opposite of the impact.

The present invention satisfies the second object by eliminating manufacturing steps to create folds, crevices, buttresses, or attach fasteners. The embodiments to be described hereafter will show that a minimal number of components needed to position the insert within the hitting portion of the bat frame do not complicate the manufacturing process as some of the prior art bat disclosures such as U.S. Pat. No. 8,007,381.

BRIEF DESCRIPTION OF DRAWINGS

The objects, features and advantages of the present invention will be apparent to one skilled in the art from reading the following detailed description in which.

DETAILED DESCRIPTION OF THE INVENTION

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention.

Figure 1:
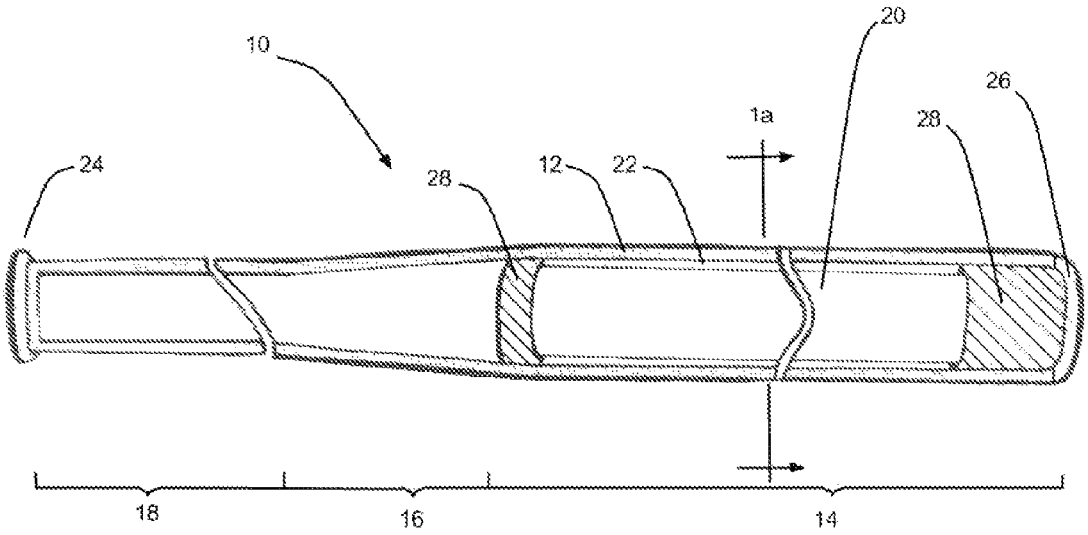
FIG. 1 shows a sectional view through the center of a bat in accordance with one aspect of this invention.
Figure 1A:
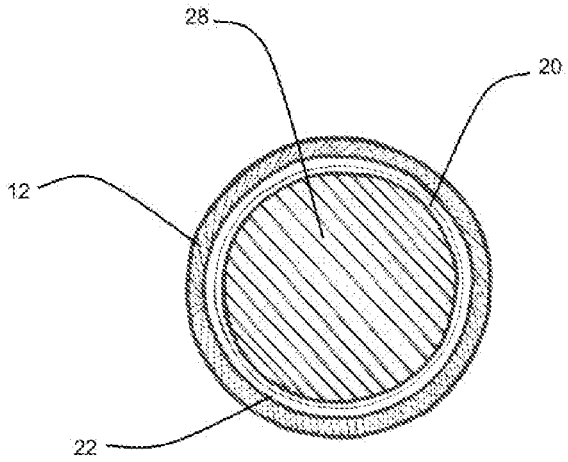
FIG. 1*a* is a cross section view of the bat of FIG. 1 hitting portion.

Referring to FIG. 1, a bat 10 has a tubular aluminum frame 12 with a relatively large-diameter hitting portion 14, an intermediate tapering portion 16, and a relatively small-diameter handle portion 18.

To provide for an improved rebound effect to better transfer of energy from the bat to a ball, the present invention provides for a tubular insert 20 to be suspended within the hitting portion 14 of the frame 12. The insert 20 has an outer diameter less than the inner diameter of hitting portion 14. As the outer diameter of insert 20 is less than the inner diameter of hitting portion 14, insert 20 does not make contact with frame 12 when the bat is at rest. A uniform gap 22 exists between insert 20 and the inner wall of frame 12. As shown in FIG. 1 gap 22 extends uniformly around insert 20 and along the length of insert 20. Although insert 20 does not make contact with frame 12 and is allowed to react to external forces completely independently of frame 12. The various embodiments contained herein show how insert's 20 position within frame 12 is maintained. The free floating nature of insert 20 improves the rebound effect in two ways; working in total elastic harmony with the wall of hitting portion 14 and damping vibrations that reduce the amount of energy being absorbed elastically.

The first improvement provided by insert 20 to the bat's rebound effect is by combining energy it has elastically absorbed with that of the wall of hitting portion 14. When a ball impacts a bat the kinetic energy present in the ball is transferred to the bat as the bat brings the ball to a halt. The transfer of energy from the ball to the bat is done in a very short amount of time, roughly about one thousandths of a second, and transfers a tremendous amount of energy as the ball compresses. Much of this energy is absorbed by the wall of the bat's hitting portion 14 elastically deforming. To increase the amount of energy absorbed the thickness of hitting portion 14 wall will need to be minimized. However this will result in increased rates of failure as the wall of hitting portion 14 will permanently deform. By suspending insert 20 energy that would normally permanently deform hitting portion 14 wall will be transferred to insert 20 by elastically deforming insert 20. As the bat continues its swing and the ball begins to leave bat insert 20 begins to release the absorbed energy by rebounding back from its elastic deformation and pushing against the wall of hitting portion 14. As the ball continues to leave the bat the wall of hitting portion 14 also begins to elastically rebound in concert with insert 20 with the combined effect causing the ball to "pop" off of the bat's hitting portion 14 rather than simply bouncing off.

The second improvement provided by insert 20 to the bat's rebound effect is by reducing the amount of energy absorbed by the bat as vibration energy. Vibrations adversely impact the rebound effect by actively working against the wall flexing. Vibrations are an oscillatory effect creating an equal amount of movement away from a resting point. As the wall is flexed energy will have to be expended to overcome the vibrations resulting in a reduction of the energy used to flex the wall and therefore a less than optimal rebound effect. Since insert 20 is completely suspended within the cavity of hitting portion 14 and is not connected to frame 12 it does not absorb any vibrating energy present on frame 12 from the impact with the baseball. As the wall of hitting portion 14 elastically deforms it comes into contact with insert 20. Initially insert 20 will not elastically deform but will move against the inside of hitting portion 14 wall opposite that of the point of impact with the ball. Once insert 20 abuts and compresses against the wall of hitting portion 14 opposite of the point of impact vibrations that exist on frame 12 will be dampened resulting in more energy being stored by elastic deformation of hitting portion 14 and insert 20.

The preferred embodiment of the present invention is shown in FIG. 1. Not only does bat 10 enhance rebound effect, it is also lightweight and easy to manufacture. Bat 10 comprises frame 12 that contains a relatively large-diameter hitting portion 14, an intermediate tapering portion 16, and a relatively small-diameter handle portion 18. A knob 24 closes the opening at handle portion 18. Foam 28 is a high density foam that is longer than insert 20 and in its resting state has a diameter greater than the diameter of insert 20. Foam 28 is compressed and then inserted into insert 20 such that it protrudes out of both ends of insert 20 with a greater protrusion out of the end of insert 20 that is closest to cap 26. The foam may be adhered to the frame by an adhesive. Finally cap 26 closes the opening at hitting portion 14. At no point does insert 20 come into contact with frame 12 when the bat is at rest allowing insert 20 to freely move within the hitting portion 14 to both absorb energy by elastic deformation and to dampen vibrations by compressing against the wall of hitting portion 14 on the side opposite to the point of impact.

Figure 2:
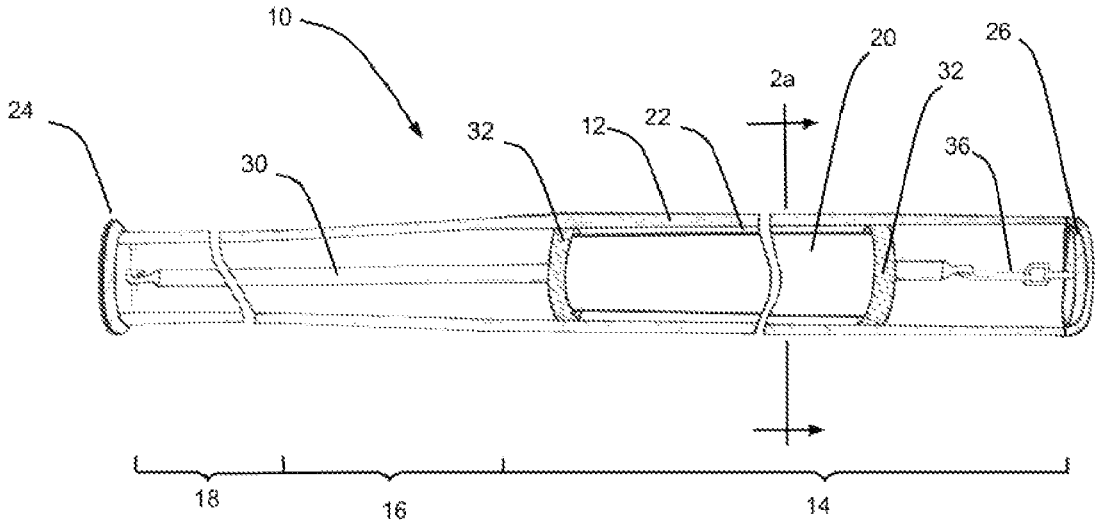
FIG. 2 shows a sectional view through the center of a bat in accordance with another aspect of this invention.
Figure 2A:
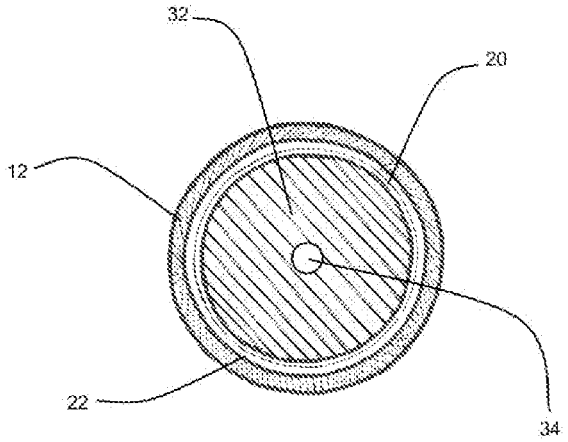
FIG. 2*a* is a cross section view of the bat of FIG. 2 hitting portion.

An alternative embodiment of the present invention is shown in FIG. 2. Bat 10 comprises frame 12 that contains a relatively large-diameter hitting portion 14, an intermediate tapering portion 16, and a relatively small-diameter handle portion 18. A knob 24 closes the opening at handle portion 18. Knob 24 contains an eyelet or other suitable fixture where line 30 is connected. Line 30 may be connected to knob 24 by a knot, adhesive, hook, or any other suitable means. Line 30 may be made of rope, wire, catgut, or of any material with a high tensile strength. Foam 32 is a high density foam that has a diameter greater than the diameter of insert 20, is longer than insert 20, and along its axis contains channel 34. Foam 32 is compressed and then inserted into insert 20. Line 30 is then passed through channel 34 and connected to rubber strap 36 on the opposing side of insert 20. As cap 26 closes the opening at hitting portion 14 any slack in rubber strap 36 is removed. Rubber strap 36 keeps line 30 rigid so that insert 20 will not come into contact with frame 12 when the bat is at rest; allowing insert 20 to freely move within the hitting portion 14 to both absorb energy by elastic deformation and to dampen vibrations by compressing against the wall of hitting portion 14 on the side opposite to the point of impact.

Figure 3:
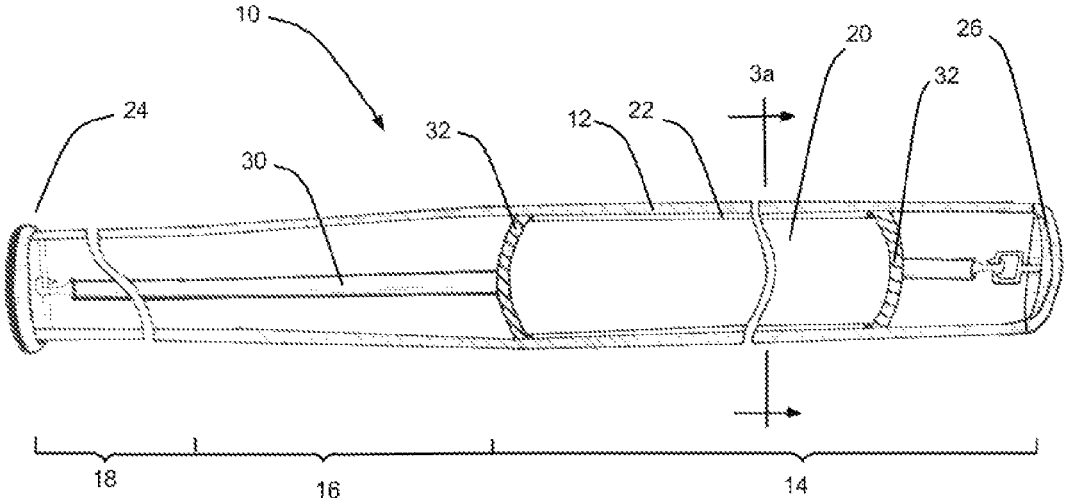
FIG. 3 shows a sectional view through the center of a bat in accordance with another aspect of this invention.
Figure 3A:
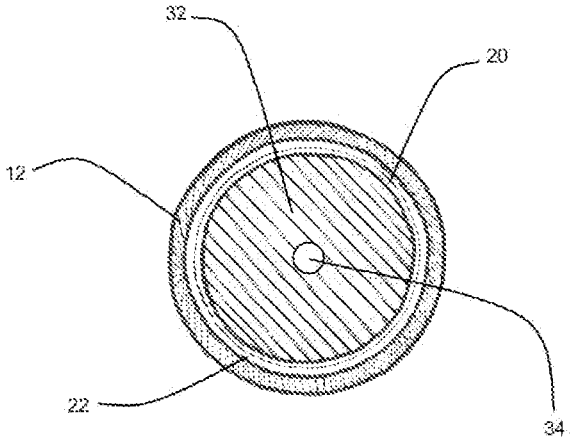
FIG. 3*a* is a cross section view of the bat of FIG. 3 hitting portion.

A second alternative embodiment of the present invention is shown in FIG. 3. This embodiment is the same as the embodiment shown in FIG. 2 with the exception that rubber strap 36 has been removed and line 30 passed through the length of frame 12 from knob 24 to cap 26. As cap 26 closes the opening at hitting portion 14 any slack in line 30 is removed so that insert 20 will not come into contact with frame 12 when the bat is at rest; allowing insert 20 to freely move within the hitting portion 14 to both absorb energy by elastic deformation and to dampen vibrations by compressing against the wall of hitting portion 14 on the side opposite to the point of impact.

Figure 4:
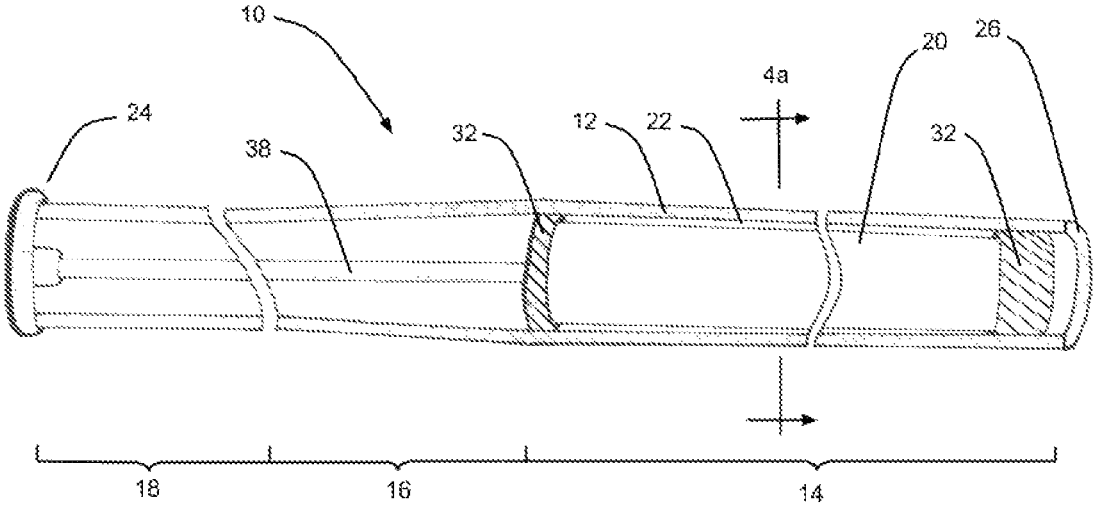
FIG. 4 shows a sectional view through the center of a bat in accordance with another aspect of this invention.
Figure 4A:
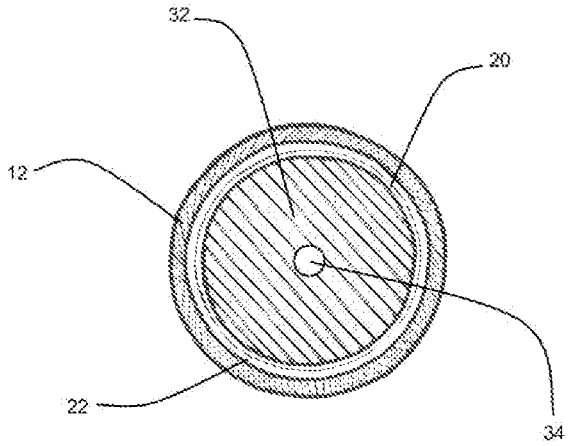
FIG. 4*a* is a cross section view of the bat of FIG. 4 hitting portion.

A final alternative embodiment of the present invention is shown in FIG. 4. This embodiment discloses bat 10 comprising of frame 12 that contains a relatively large-diameter hitting portion 14, an intermediate tapering portion 16, and a relatively small-diameter handle portion 18. A knob 24 closes the opening at handle portion 18. Tube 38 is attached to knob 24 and extends through handle portion 18, tapering portion 16, and through insert 20. Foam 32 is a high density foam that has a diameter greater than the diameter of insert 20, is longer than insert 20, and along its axis contains channel 34. Foam 32 is compressed and then inserted into insert 20. Tube 38 is then passed through channel 34. Cap 26 closes the opening at hitting portion 14. Tube 38 positions insert 20 so that it will not come into contact with frame 12 when the bat is at rest; allowing insert 20 to freely move within the hitting portion 14 to both absorb energy by elastic deformation and to dampen vibrations by compressing against the wall of hitting portion 14 on the side opposite to the point of impact.

The embodiments disclosed herein are understood to be illustrative and not limiting in any sense. It is intended that the scope of the present invention is not limited by the above described embodiments but by the claims and it covers all modifications equivalent to the claims.

I claim:

1. A bat, comprising:

a tubular frame having a circular cross-section, the tubular frame including a large diameter hitting portion, an intermediate tapering portion, and a small diameter handle portion;

a tubular insert positioned within the large diameter hitting portion, the insert having a circular cross-section, the insert having first and second ends, the insert being separated from the tubular frame by a void gap along the entire length of the insert, the gap being largely of constant width, the gap having such width so that the insert and the tubular frame will elastically deform in conjunction with each other when a baseball is struck;

a foam fitted within the insert, the foam protruding beyond the first and second ends of the insert and expanding beyond first and second ends of the insert such that the diameter of the expanded foam is greater than an outer diameter of the insert, allowing the insert to be suspended within the tubular frame, to move independently of the tubular frame, and to elastically deform in conjunction with the tubular frame when a baseball is struck to improve the rebound effect;

a knob covering an exposed end of the handle portion; and a cap covering an exposed end of the hitting portion.

2. The bat according to claim 1 in which the foam is adhered to the tubular frame by an adhesive.

* * * * *